US009527305B2

(12) United States Patent
Dubuit et al.

(10) Patent No.: US 9,527,305 B2
(45) Date of Patent: Dec. 27, 2016

(54) INK JET PRINTING MACHINE

(71) Applicant: MACHINES DUBUIT, Noisy le Grand (FR)

(72) Inventors: Jean-Louis Dubuit, Paris (FR); François Dumenil, Chaumes en Brie (FR)

(73) Assignee: MACHINES DUBUIT (FR)

( * ) Notice: Subject to any disclaimer, the term of this patent is extended or adjusted under 35 U.S.C. 154(b) by 0 days.

(21) Appl. No.: 14/450,837

(22) Filed: Aug. 4, 2014

(65) Prior Publication Data

US 2015/0042706 A1 Feb. 12, 2015

(30) Foreign Application Priority Data

Aug. 6, 2013 (FR) ..... 13 57831

(51) Int. Cl.

| | |
|---|---|
| ***B41J 3/00*** | (2006.01) |
| ***B41J 3/407*** | (2006.01) |
| ***B41J 2/01*** | (2006.01) |
| ***B41J 11/00*** | (2006.01) |

(52) U.S. Cl.

CPC *B41J 3/407* (2013.01); *B41J 2/01* (2013.01); *B41J 3/4073* (2013.01); *B41J 11/0015* (2013.01)

(58) Field of Classification Search

CPC ..... B41J 2/01; B41J 3/407; B41J 11/0015

USPC ..... 347/4

See application file for complete search history.

(56) References Cited

U.S. PATENT DOCUMENTS

| | | | | |
|---|---|---|---|---|
| 5,142,975 | A * | 9/1992 | Podalsky et al. | 101/40.1 |
| 5,207,156 | A * | 5/1993 | Helling | B41F 15/30 101/126 |
| 5,317,967 | A * | 6/1994 | Heidenreich | 101/38.1 |
| 5,553,536 | A * | 9/1996 | Van Os | 101/44 |
| 6,135,654 | A | 10/2000 | Jennel | |
| 6,283,022 | B1 * | 9/2001 | Kamen | B41F 15/0872 101/120 |

(Continued)

FOREIGN PATENT DOCUMENTS

| | | |
|---|---|---|
| EP | 1 088 661 A2 | 4/2001 |
| WO | WO 2012/093077 A1 | 7/2012 |

OTHER PUBLICATIONS

French Search Report dated Apr. 10, 2014 issued in corresponding French patent application No. 13 57831.

*Primary Examiner* — Jannelle M Lebron
*Assistant Examiner* — Jeremy Bishop
(74) *Attorney, Agent, or Firm* — Ostrolenk Faber LLP

(57) ABSTRACT

An improved ink jet printing machine (10) having an object loading means (30), capable of placing an object (1) in a first standby position on a first support (11) of the machine; a pretreatment station (40), including a first object holder (50) capable of: gripping an object (1) in the first standby position; bringing it into a pretreatment position in order to allow a pretreatment device (41) to perform a pre-treatment process on the said object; and, upon conclusion of the pretreatment, bringing it into a second standby position on a second support (12) of the machine; a printing station (60), including a second object holder (70) capable of: gripping an object in the second standby position; bringing it into a printing position in order to allow an inkjet type printing device to print the desired graphic on the said object; and, upon conclusion of the printing process, transferring it to an unloading means (80).

12 Claims, 8 Drawing Sheets

(56) References Cited

U.S. PATENT DOCUMENTS

| | | | | |
|---|---|---|---|---|
| 6,513,435 | B2 * | 2/2003 | Detzner | C03C 17/245 101/35 |
| 6,578,474 | B1 * | 6/2003 | Sasaki | 101/35 |
| 7,647,867 | B2 * | 1/2010 | Byron | 101/37 |
| 8,667,895 | B2 * | 3/2014 | Gerigk et al. | 101/35 |
| 2006/0154035 | A1 | 7/2006 | Iwata | |
| 2006/0250464 | A1 * | 11/2006 | Sheinman | B41J 3/4073 347/101 |
| 2012/0011807 | A1 * | 1/2012 | Preckel et al. | 53/167 |
| 2013/0000499 | A1 | 1/2013 | Ookubo et al. | |

* cited by examiner

INK JET PRINTING MACHINE

CROSS-REFERENCE TO RELATED APPLICATIONS

The present application claims benefit of French Application No. 13 57831, filed Aug. 6, 2013, the disclosure of which is incorporated herein by reference.

TECHNICAL FIELD OF THE INVENTION

The present invention relates to the field of ink jet printing machines.

BACKGROUND OF THE INVENTION

The document U.S. Pat. No. 6,135,654 discloses an ink jet printing machine. An object to be printed is placed on a belt conveyor in order to be presented successively to a pretreatment device, an ink jet printing device and a drying device.

However, an ink jet printing apparatus requires a very high degree of precision in the relative positioning between the surface of the object to be printed and the ink ejection nozzles. This precision is of the order of several microns (μm). However, the use of a belt conveyor does not provide the means to achieve a such precision.

SUMMARY OF THE INVENTION

The object of the invention is therefore to overcome this problem by providing an improved ink jet printing machine.

In order to accomplish this, the invention relates to an ink jet printing machine that is in accordance with the claims herein.

BRIEF DESCRIPTION OF THE DRAWINGS

The invention and its advantages will be better understood upon reviewing the description that follows of a particular embodiment, provided purely by way of illustration and without any limitation, and with reference being made to the accompanying drawings in which.

DESCRIPTION OF EMBODIMENTS

Figure 1:
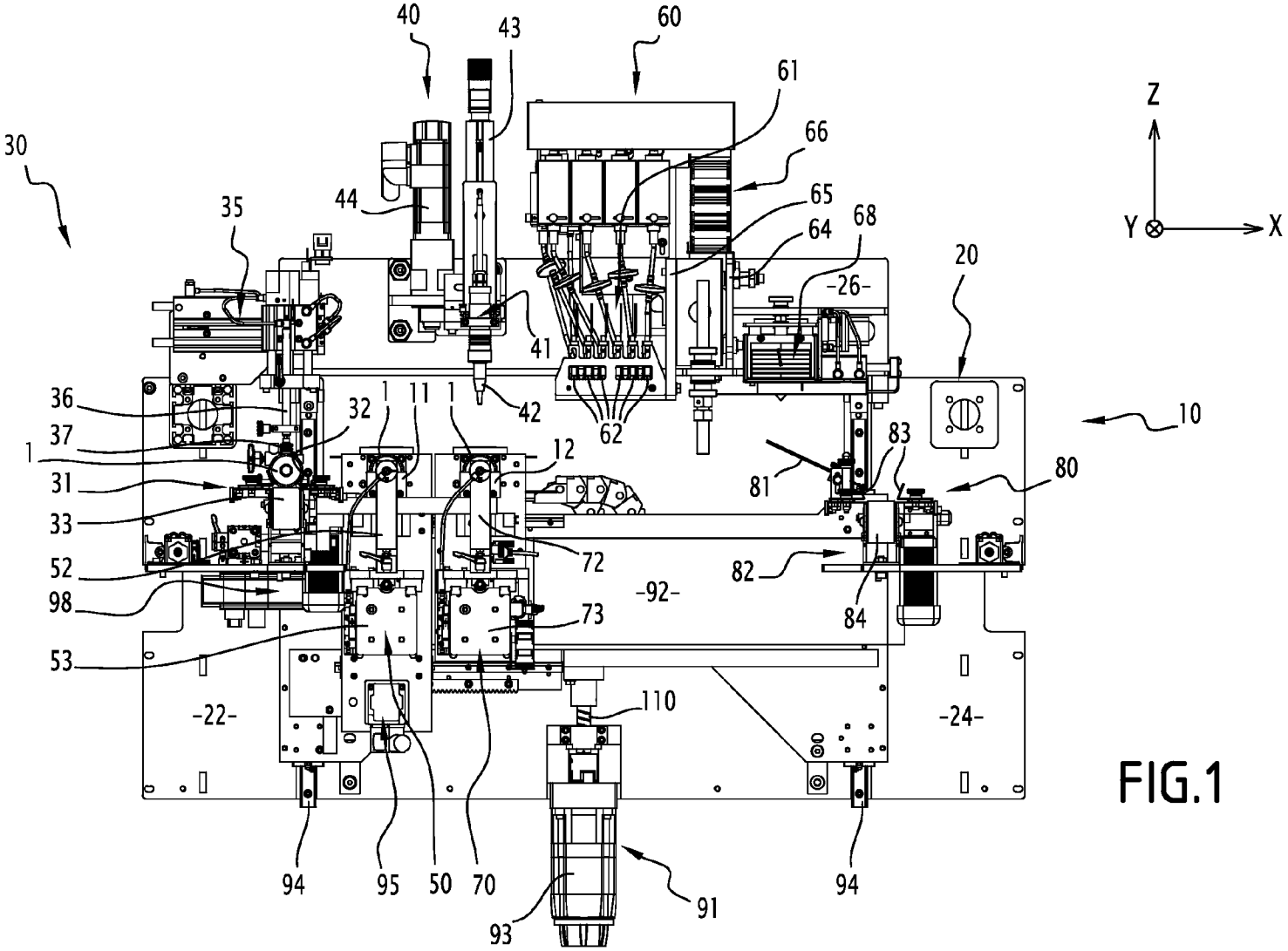
FIG. 1 is a front view of the printing machine according to a preferred embodiment.

The structure of the ink jet printing machine 10 will be described with reference to FIGS. 1 and 2.

The machine 10 provides the ability to print a graphic or a pattern directly on an object 1.

The object 1 has the shape of a circular cylinder about a main axis. The object 1 is for example a bottle.

The object 1 is for example made of glass.

The machine 10 comprises a frame 20 resting on foundations (not shown).

The frame 20 comprises of two lateral upright posts 22 and 24, arranged vertically, and one cross piece member 26, arranged horizontally and supported by the upright posts.

An orthonormal reference system XYZ is associated with the frame 20.

The X axis corresponds to the longitudinal axis of the cross piece member 26. It is oriented from left to right in the FIG. 1.

The Z axis corresponds to the vertical axis and is oriented from the bottom upwards.

The Y axis is normal to the XZ plane in FIG. 1, and is oriented towards the rear of this figure.

The machine 10 is equipped with first and second supports, 11 and 12. In this present embodiment, the first and second supports 11 and 12 are fixed on the frame 20.

Each support has a shape that is adapted to that of the object, in a manner so as not to be in contact with the portion of the surface of the object meant to be printed. In this way, mechanical friction, which contributes to the risk of degrading the quality of the pattern printed on the object, is avoided between the support and the portion of the surface of the object meant to be printed. In the embodiment described, each support thus possesses a "V" shaped form. Such a support ensures the ability to receive an object, placed in position or taken, by approaching from above.

The first support 11 defines a first standby position for an object.

The second support 12 defines a second standby position for an object.

The machine 10 includes, on the same side of the frame, and successively along the X axis, the object loading means 30, a first pretreatment station 40, a second ink-jet printing station 60 and an unloading means 80.

Object Loading Means 30

The object loading means 30 has the function of placing a first object 1, on the first support 11, in the first standby position.

The object loading means 30 comprises a feeding line 31 extending horizontally, substantially parallel to the Y axis. The line 31 has lateral guide rails and a base 32 constituted by a conveyor belt 33. The setting in motion of the conveyor belt 33, by suitable means, ensures the ability to move an object 1 along the feed line, along the positive orientation of the Y axis. The object 1 is moved from one open end of the line 31, located at a distance away from the frame 20, until an end stop 34, located at the other end of the line 31, in the proximity of the frame 20. The object in contact against the end stop 34 is in a reserve position.

The loading means 30 comprises a gripping device 35, of the type with suction cups, capable of moving an object from the reserve position to the first standby position on the first support 11. The device 35 is fastened on to the upper part of the upright post 22 on the side thereof facing the line 31. The device 35 comprises a vertical rod 36 whose lower end is provided with a suction cup 37. A first actuating means for actuating the device 35 makes it possible to move the rod 36 vertically from the bottom upwards and vice versa. A second actuating means for actuating the device 35 makes it possible to move the rod 36 horizontally, between a position directly above the reserve position and a position directly above the first support 11, and vice versa.

By way of a variant, the object loading means comprises of other components that provide the ability to carry out an elementary operation on the object upstream of the pretreatment station.

First Station 40

The first pretreatment station 40 includes a pretreatment device 41.

The pretreatment device 41 is a device for plasma pretreatment. It comprises a torch 42 used for carrying out a pretreatment process on one portion of the surface of an object placed so as to face the torch 32.

The device 41 is mounted on the cross piece member 26.

The device 41 is fixed along the X axis, but mounted so as to be movable relative to the frame 20 along the Z and Y axes. An adjusting means 43 provides the ability to move the device 41 along the Z axis in a manner so as to be able to adjust with precision the Z coordinate of the torch 42 at the start of each period of use of the machine 10. A moving means 44 enables the motion of the device 41, along the Y axis, during the pretreatment processing. In this way, the torch 42 is capable of pretreating an object on a segment oriented along the Y axis.

The first station 40 includes a first dedicated object holder 50

The first object holder 50 is of the socket/pin type. It comprises a fixed base socket 51 and a retaining pin 52, that can be translated along a profiled rail 53.

The first object holder 50 comprises a clamping means to enable the movement of the pin 52 towards the socket 51 so as to clamp an object placed between the socket and the pin or away from the socket 51 so as to release an object held between the socket and the pin. The first object holder 50 is thus adapted to hold an object along a holding axis, passing through its base socket and its retaining pin. In order to ensure proper holding, the holding axis coincides with the main axis of the object being held.

The first object holder 50 is mounted so that its holding axis is, at all times during the operation of the machine 10, parallel to the Y axis.

The first object holder 50 is provided with a pivot means 55 which ensures the ability to rotate the object held, about the holding axis, on a required angle and/or with a required angular velocity, in a manner so as for example, to ensure the running of the surface of the object in front of the torch 42.

The first object holder 50 is capable of performing an operative cycle consisting of the following:

- gripping an object 1 in the first standby position;
- moving it in order to bring it into a pretreatment position;
- moving the object by pivoting it, in order to pretreat a portion of the surface of the object;
- then, upon conclusion of the pretreatment, bringing the object from the pretreatment position into the second standby position on the second support 12, before returning empty to its operative cycle start position, in alignment with the first support 11.

The pretreatment position is such that the distance between the torch 42 of the device 41 and the point on the surface of the object that the torch 42 is in the process of pretreating at the current time is equal to a distance required in order for the pretreatment process to be optimal.

Second Station 60

The second station 60 comprises an ink jet type printing device 61.

In the embodiment shown in the figures, the device 61 comprises six printing units 62. Each unit 62 is dedicated to the printing of an elementary pattern by means of an ink having one colour specific to each unit. The pattern printed on the object results from the superposition of the elementary patterns.

A unit 62 includes a nozzle (not shown) for propelling droplets of ink. A unit 62 is driven so as to propel the ink according to the elementary pattern on a portion of a surface of an object.

In the embodiment described, the six nozzles are arranged in a horizontal plane XY. They are aligned along an axis parallel to the X axis and spaced apart from each other by a predetermined pitch p.

The device 61 is mounted on a support arm 64 fixed on to the cross piece member 26 of the frame 20 and extending horizontally, along the Y axis, away from the cross piece member 26.

The printing device 61 is fixed along the X axis and along the Z axis relative to the frame 20.

The printing device 61 is borne on a mobile plate 65 movable along the support arm 64. A movement means 66 provides the ability to move the plate 65 in translation along the Y axis, such that the nozzle of an active printing unit 62 is able to propel the ink droplets on an object 1 along a segment parallel to the Y axis.

In the embodiment described here in detail, the second station 60 includes, downstream from the printing device 61, a drying device 68. This is for example an ultraviolet oven. The drying device 68 performs the function of drying the ink deposited on an object prior to its transfer to the unloading means 80.

The drying device 68 is mounted on the support arm 64, on the side thereof opposite to the side bearing the printing device 61. The drying device 68 is integrally secured to the support arm.

Figure 6:
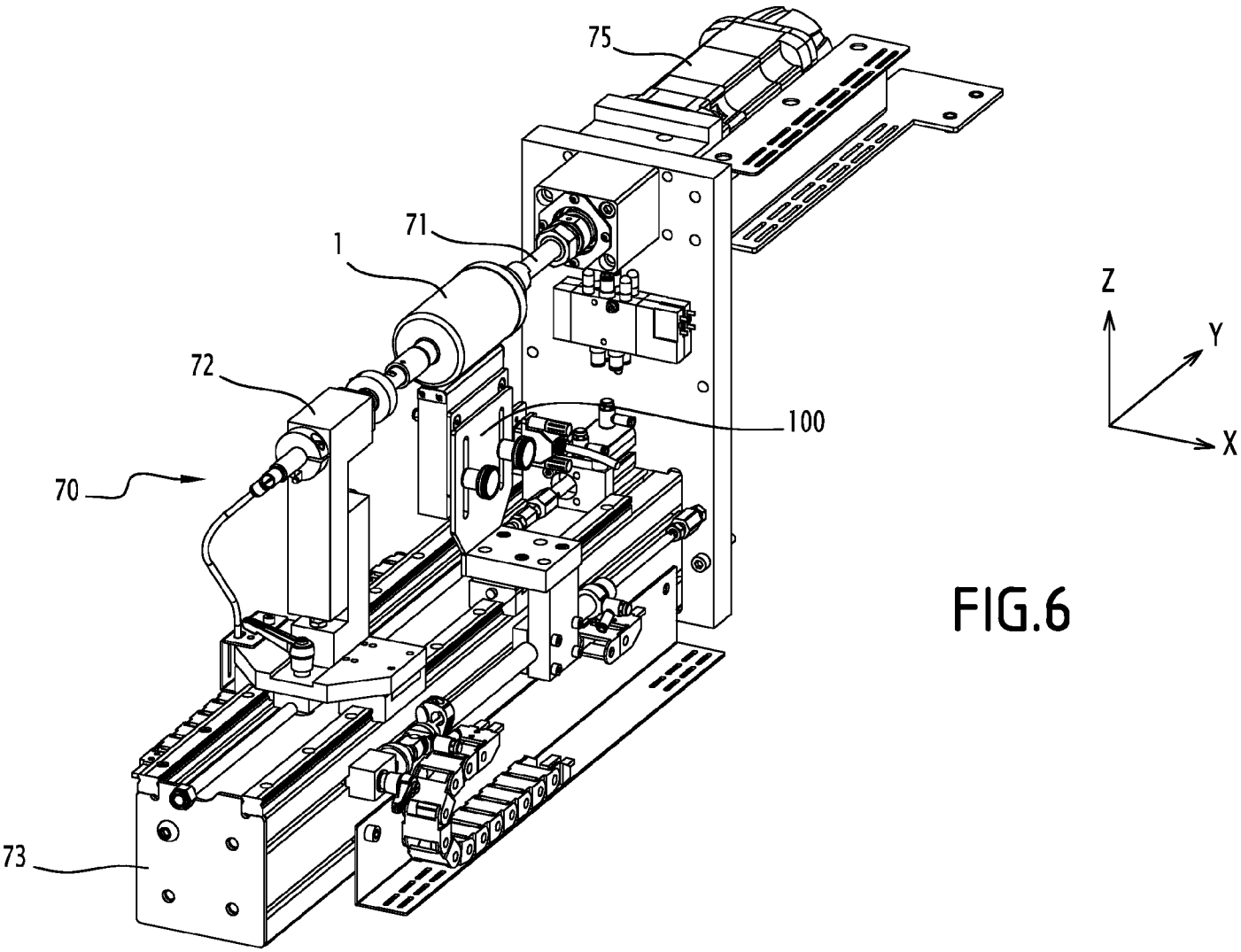
FIG. 6 is a perspective representation of a second object holder dedicated to printing station of the machine represented in FIG. 1.

The second station 60 includes a second dedicated object holder 70. It is shown in detail in FIG. 6.

The second object holder 70 is of the socket/pin type. It comprises a fixed base socket 71 and a retaining pin 72, that is movable in translation along a profiled rail 73.

The second object holder 70 comprises a clamping means to enable the movement of the pin 72 towards the socket 71 so as to clamp an object placed between the socket and the pin, or away from the socket 71 so as to release an object held between the socket and the pin. The second object holder 70 is thus adapted to hold an object along a holding axis, passing through its base socket and its retaining pin. The holding axis coincides with the main axis of the object being held.

The second object holder 70 is mounted in a manner such that its holding axis is parallel to the Y axis. The second object holder 70 is mounted to be parallel to the first object holder 50.

The second object holder 70 is provided with a pivot means 75 which ensures the ability to rotate the gripped object about the holding axis, on a required angle and/or with a required angular velocity, so as to ensure the running of a generatrix of the object in front of an active unit 62 of the printing device 61 or in front of the drying device 68.

The second object holder 70 further includes an auxiliary drying device 100.

This latter is mounted so as to be movable in translation along a direction parallel to the holding axis, over the profiled rail 73 for supporting the pin 72.

In a retracted position of the auxiliary drying device 100, the second object holder 70 is capable of gripping an object placed on the second support 12.

Once the object has been gripped and held in position, the auxiliary drying device 100 is moved into an operational position, wherein it is capable of drying a portion of the surface of the gripped object.

Advantageously, in its operational position, the auxiliary drying device 100 does not interfere with the printing device 61. In this manner, the auxiliary drying device 100 may be activated so as to dry a portion of the surface of the object that has been printed, while the printing device 61 propels ink onto another portion of the surface of the object.

The second object holder 70 is capable of performing an operative cycle consisting in:

- gripping an object in the second standby position on the second support 12, and moving it to the first printing position of six successive printing positions;
- sequentially moving the object from one printing position to the subsequent printing position; and
- in each printing position, moving the object relative to the printing device;
- moving the object from the sixth and last printing position to a drying position;
- releasing the object in order to transfer it to the unloading means 80;
- returning empty from the drying position to its initial starting position in alignment with the second support 12, for the subsequent operative cycle.

Each printing position is associated with a unit 62 of the printing device 61.

A printing position is such that the distance between the nozzle of the unit 62 and the point on the surface of the object that receives the ink propelled by this nozzle is equal to a distance required in order for the printing process to be optimal.

A drying position is such that the distance between the drying device 68 and the portion of the surface of the object that receives the UV flux is equal to a distance required in order for the drying process to be optimal.

Unloading Means 80

The unloading means 80 has a ramp 81 that allows, when the second object holder 70 is opened, an object to roll or slide to a discharging line 82.

The discharging line 82 extends horizontally, substantially parallel to the Y axis. The discharging line 82 includes lateral guide rails 83 and a base consisting of a conveyor belt 84. The setting in motion of the conveyor belt 84 by suitable means ensures the ability to move an object along the discharging line 82, in the negative orientation of the Y axis. The object is moved from one end of the line 82 located in the proximity of the frame 20 to an open end 85 located at a distance away from the frame 20.

By way of a variant, the unloading means includes other components used for performing basic operations on the object downstream of the printing station.

Means for Moving the Object Holders

The machine 10 comprises means for moving the object holders 50 and 70.

In order to simplify the machine, the Z axis coordinates of the first and second standby positions, respectively on the first and second supports 11 and 12, are identical and the Z axis coordinates of the pretreatment processing position, the printing positions and the drying position are identical. The travel paths of the first and second object holders 50 and 70 along the axis Z are thus identical. They are synchronised by using a common means 91 for the movement along the Z axis.

The means 91 for the movement along the Z axis of the object holders 50 and 70 comprises a horizontal beam 92, mounted to be movable between the upright posts 22 and 24 of the frame 20. The longitudinal axis of the beam 92 extends parallel to the X axis.

A single motor 93, coupling means of the ball screw type and guide assemblies 94 for guiding the beam on each of the upright posts 22 and 24, enable the precise movement of the beam 92, in translation along the Z axis.

The first and second object holders 50 and 70 are mounted on to the beam 92, independently of one another.

Each object holder is mounted to be movable along the longitudinal axis of the beam 92, that is to say along the X axis.

In order to do this, a means 95 for the movement along the X axis of the first object holder 50 comprises a motor, coupling means and a guide assembly for guiding the object holder over the beam. The actuating means 95 enables the precise movement of the first object holder along the beam 92.

In a similar manner, a means 98 for the movement along the X axis of the second object holder 70 comprises a motor, coupling means and a guide assembly for guiding the object carrier over the beam. The actuating means 98 enables the precise movement of the first object holder 70 along the beam 92.

In order to further simplify the machine 10, and since the pretreatment device 41 and the printing device 61 are adjustable along the Y axis, the first and second standby positions on the supports 11 and 12 and the pretreatment position, the printing positions and the drying position are identical along the Y axis. The first and second object holders 50 and 70 therefore do not need to be moved along the Y axis. In this present embodiment, the machine 10 thus does not include means for movement in the Y axis.

Operation

The operation of the machine 10 will now be described, initially by following the movement of the same given object 1 through the machine 10.

A given object 1 is placed at the end of the object feeding line 31.

The running of the conveyor belt 33 enables the movement of the object along the Y axis.

The object 1 travels along the feeding line 31, until coming into contact with the end stop 34 at the other end of the feeding line 31.

The object is then in a reserve position.

The gripping device 35 is actuated cyclically so as to transfer an object in the reserve position to the first standby position on the first support 11. In order to do this, while the gripping device 35 is located in an initial position in which the rod 36 is directly above the object 1 in the reserve position, the rod 36 is lowered vertically, in a manner such that the suction cup 37 comes into contact with the surface of the object 1. A negative pressure is then applied to the suction cup 37 so as to secure the object 1 to the rod 36. The rod 36 is subsequently raised vertically, and then moved in translation along the X axis so as to come directly above the first support 11. The rod 36 is then lowered vertically so as to place the object 1 on the first support 11. At this time, the balancing of the pressures in the suction cup 37 enables the releasing of the object 1 from the gripping device 35. The rod 36 is then raised vertically. The gripping device 35 returns empty to its initial position in a manner so as to be able to take up the next object on the feeding line 31.

The first object holder 50 is moved in order to perform the following operative cycle.

From an operative cycle start position in alignment with the first support 11, the object holder 50 is actuated so as to grip the object 1. To do this, the pin 52 is moved towards the socket 51 in order to clamp the object 1. The object is then held in position along a holding axis oriented along the Y axis.

Figure 3:
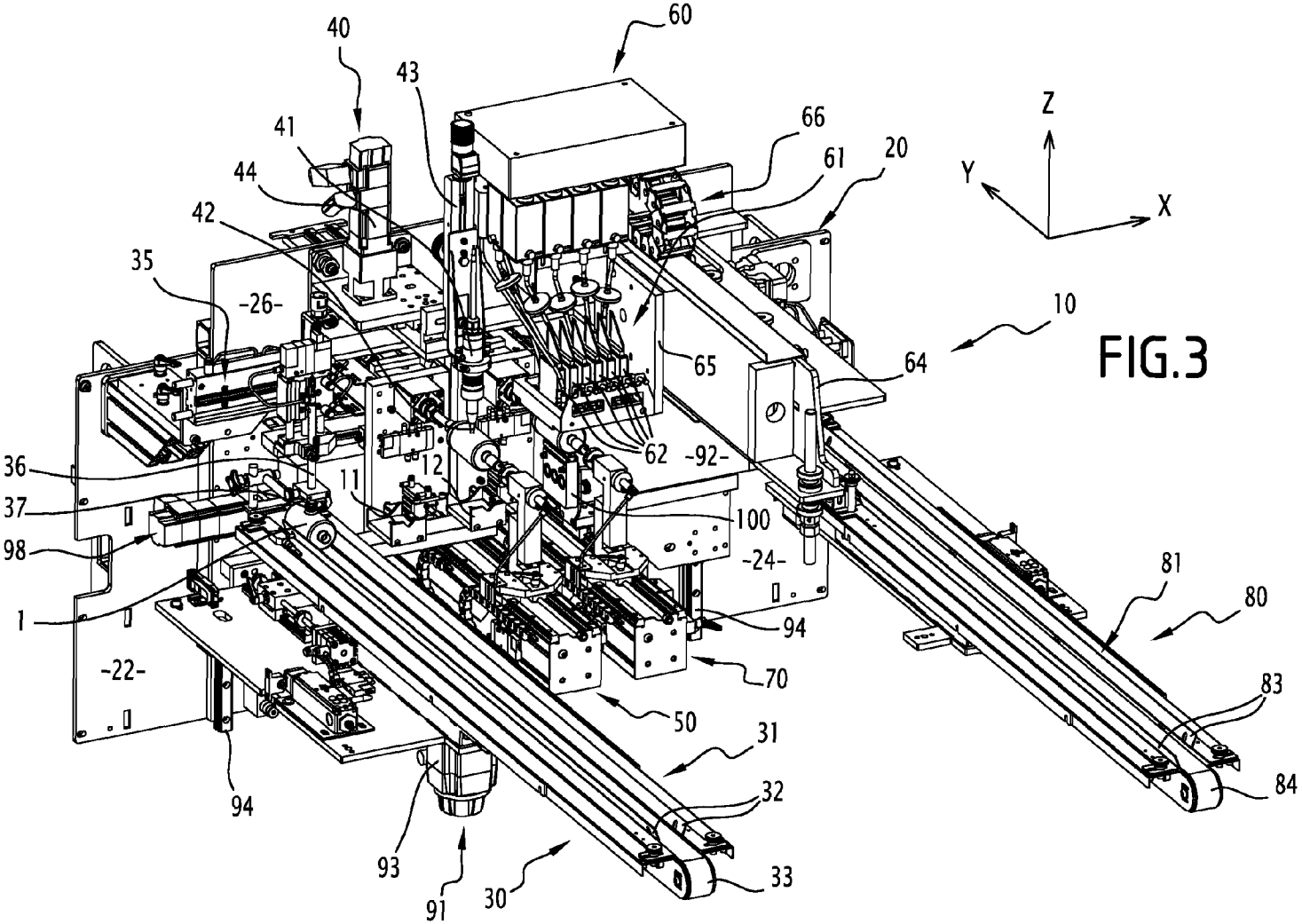

Then, the means for the movement along the X axis and the Z axis are driven in order to, during the movement of the first object holder 50, bring the object gripped from the first standby position on the first support 11 to the pretreatment position (shown in FIG. 3). This movement takes place by combining a translation along the Z axis on a distance ΔZ and a translation along the X axis on a distance +ΔX1. The translation movement along the Z axis is obtained by a first displacement of the beam 92 resulting from the actuation of the means 91 for the movement in the Z axis, that is common to the object holders 50 and 70. The translational movement along the X axis is caused by the actuation of the means 95 for the movement along the X axis of the first object holder 50.

The first object holder 50 maintains the object 1 in the pretreatment position for the time period during which the pretreatment device 41 performs the required pretreatment process. During this pretreatment process, the pivoting means 55 of the first object holder 50 is eventually used in order to cause the rotation of the object 1 relative to the pretreatment device 41, in a manner such that different generatrix of the object pass in front of the pretreatment device. This movement, combined with the translation movement in the Y axis of the pretreatment device 41, ensures the ability to pretreat an extended portion of the surface of the object.

Figure 5:
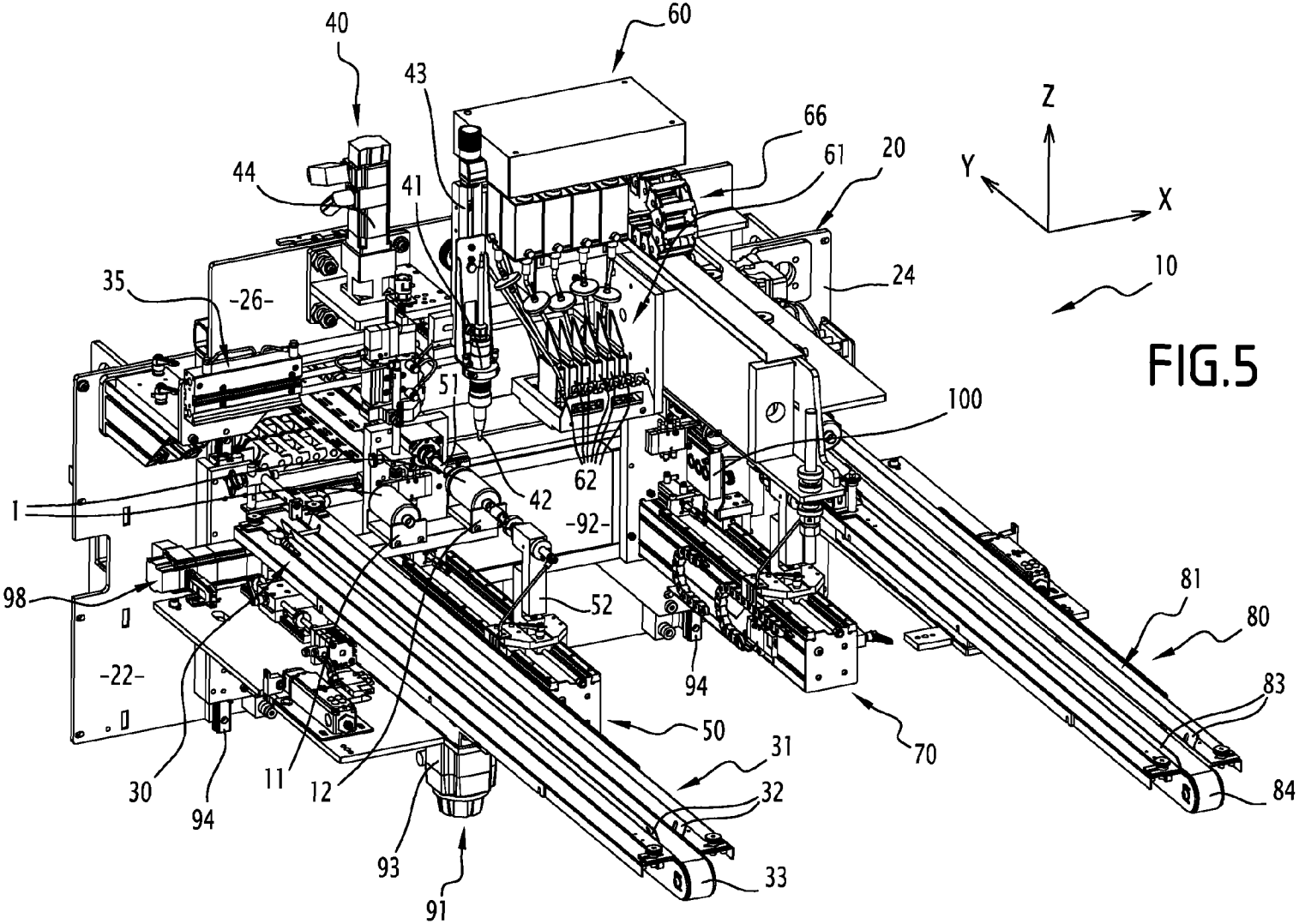

In the end of the pretreatment process, the means for the movement along the X and Z axis are driven in order to, during the movement of the first object holder 50, move the object from the pretreatment position, to the second standby position on the second support 12 (the position shown in FIG. 5). This movement takes place by combining a translational movement along the Z axis on a distance −ΔZ and a translation along the X axis on a distance +ΔX2. The Z translation is obtained by a second displacement of the beam 92 resulting from the actuation of the means 91 for the movement along the Z axis that is common to the object holders 50 and 70. The X translation is caused by the actuation of the means 95 for the movement along the X axis of the first object holder 50.

The first object holder 50 is then actuated so as to release the pretreated object on the second support 12. In order to do this, the pin 52 is moved away from the socket 51.

Figure 2:
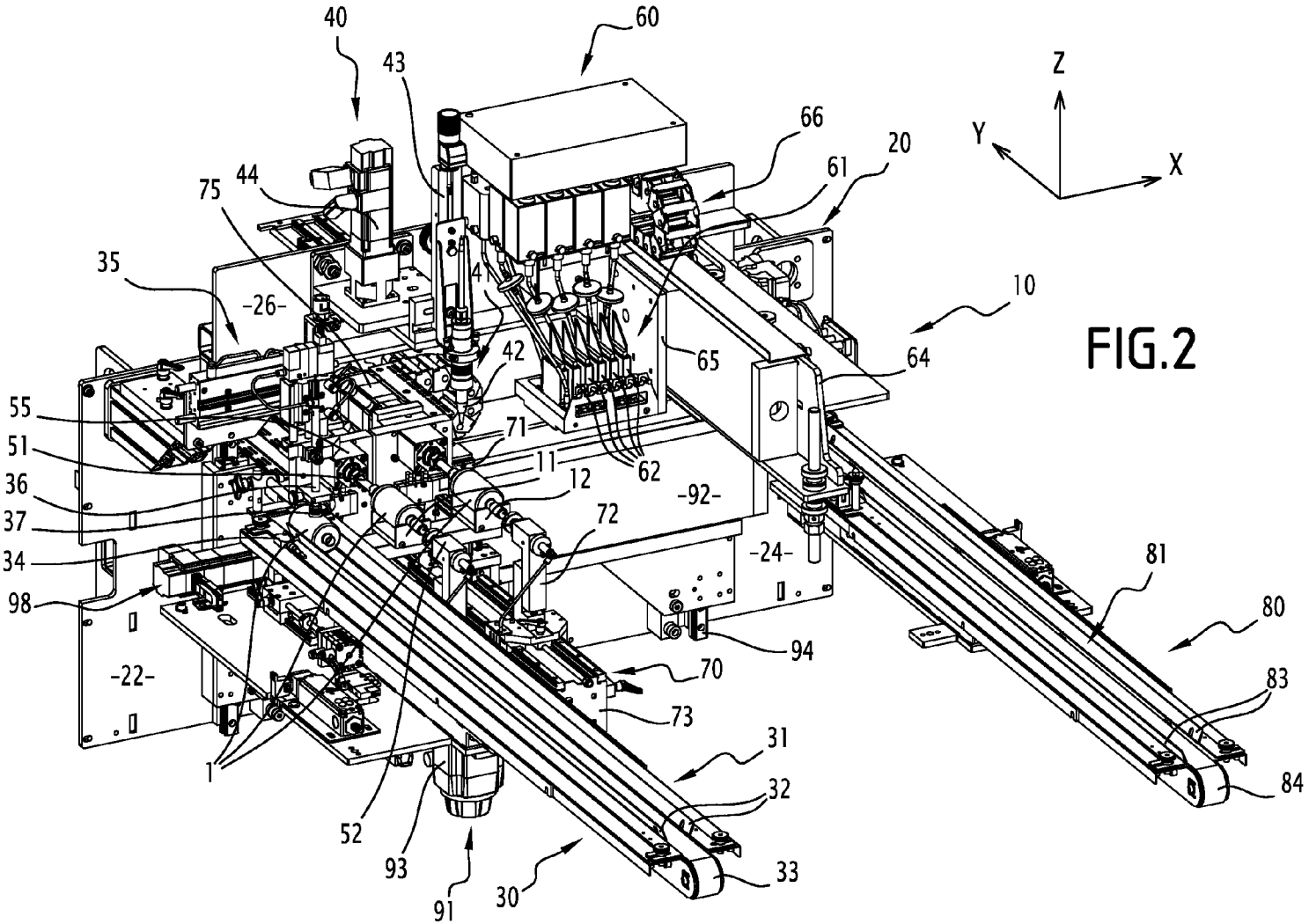
FIGS. 2 to 5 are perspective views of the machine represented in FIG. 1, in various different states of operation.

Once the object 1 has been placed in the second support 12, the means 95 for the movement of the object holder 50 along the X axis is driven so as to bring the first object holder 50 into its operative cycle start position (shown in FIG. 2). This movement takes place by bringing about a translational movement along the X axis on a distance −(ΔX1+ΔX2).

The second object holder 70 is moved in order to perform the subsequent operative cycle.

In its operative cycle start position, the second object holder 70 is in alignment with the second support 12 (FIG. 2). It is actuated so as to grip the object 1 which is appropriately placed in position. To do this, the pin 72 is moved towards the socket 71 in order to clamp the object. The object is then held along a holding axis oriented along the Y axis.

Then, the means for the movement along the Z axis and X axis are driven in order to, during the movement of the second object holder 70, bring the gripped object from its second standby position on the second support 12, to the first printing position (as shown in FIG. 3). This movement takes place by combining a translation along the Z axis on a distance +ΔZ and a translation along the X axis on a distance +ΔX3. The Z translation is obtained by the first displacement of the beam 92 resulting from the actuation of the means 91 for the movement along the Z axis, that is common to the object holders 50 and 70. The X translation is caused by the actuation of the means 98 for the movement along the X axis of the second object holder 70.

The second object holder 70 maintains the object in the first printing position for the time period during which the first unit prints the first elementary pattern.

Then, the means 98 for the movement along the X axis, of the second object holder 70, is driven so as to translate the second object holder 70 by a quantity corresponding to the pitch p between the first and second units 62. Once the object is in the second printing position, the second unit is activated so as to print a second elementary pattern. Step by step, the object passes successively in front of each unit 62.

Thus, the second object holder 70 undergoes an overall translational movement along the X axis on a distance corresponding to the pitch p separating two successive units 62 multiplied by the number of intervals between the units 62 of the printing device. When the printing device comprises six units 62, the second object holder 70 undergoes a translational movement of +ΔX4=5*p.

Possibly, in each printing position, the pivoting means 75 of the second object holder 70 is used in order to cause the rotation of the object 1 about the Y axis relative to the printing device 61, in a manner such that different generatrices of the object pass in front of the printing device 61. This rotational movement, combined with the translational movement of the printing device 61 along the Y axis, ensures the ability to print a pattern on an extended portion of the surface of the object. This is particularly advantageous when the portion of the surface of the object that is meant to receive a pattern is of a significant length along the Y axis, which is greater than the length along the Y axis that a printing unit is able to print during a single pass.

Figure 4:
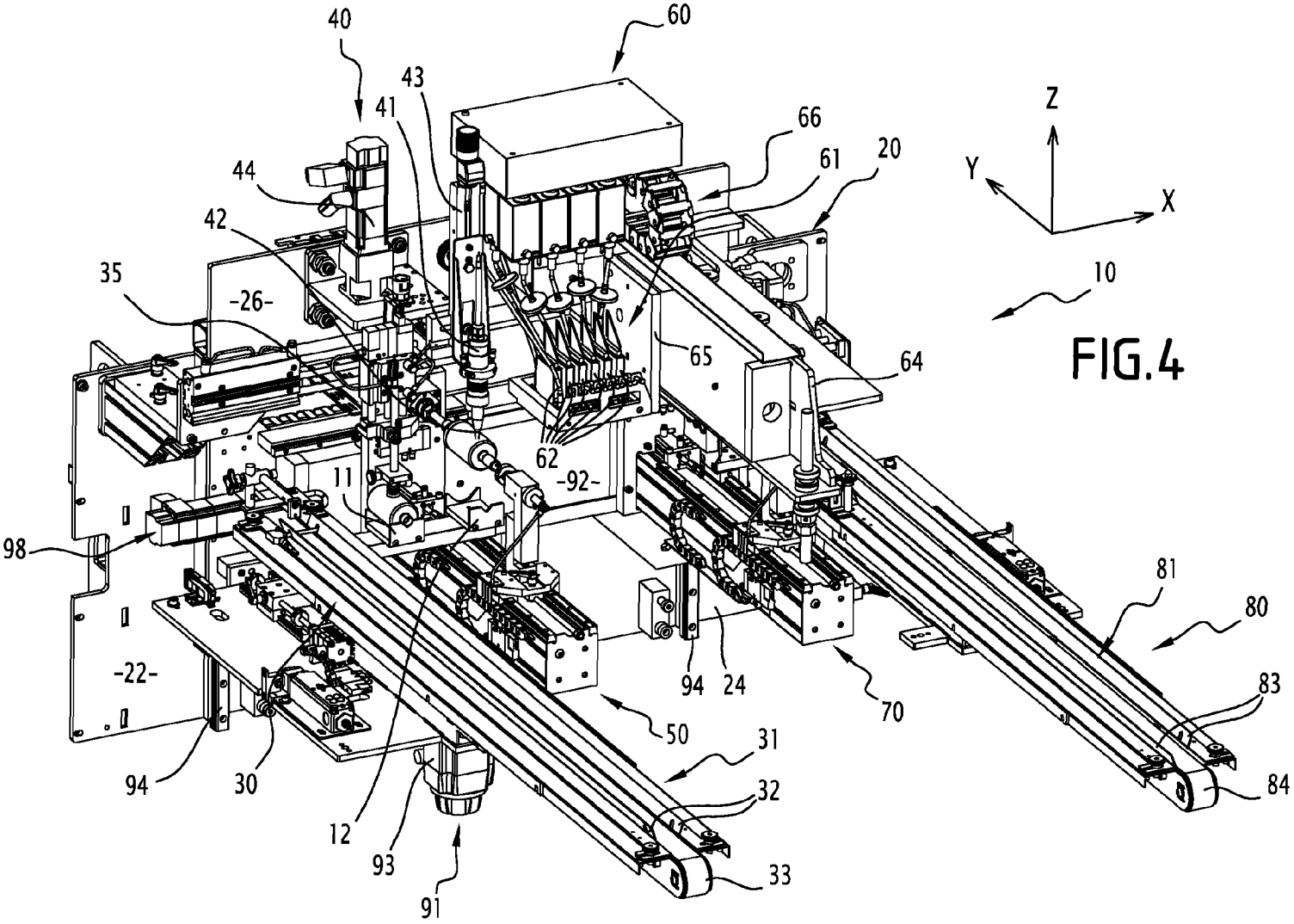

Then, the means 98 for the movement along the X axis of the object holder 70 is driven so as to move the object 1 from the sixth printing position to the drying position (shown in FIG. 4). During this movement the object holder 70 undergoes a translational movement of +ΔX5.

In the end of the drying process, the second object holder 70 is actuated so as to place the object on the ramp 81. To do this, the pin 72 is moved away from the socket 71.

Once the object has been transferred to the unloading means 80, the means for the movement along the X and Z axis are driven in order to, during the movement of the second object holder 70, bring it back to its operative cycle start position. This movement takes place by bringing about a translational movement along the Z axis on a distance −ΔZ and a translational movement along the X axis on a distance −(ΔX3+ΔX4+ΔX5). The Z translation is obtained by the second displacement of the beam 92 resulting from the actuation of the means 91 that is common to the object holders 50 and 70. The X translation is generated by the actuation of the means 97 of the second object carrier 70.

The object 1 placed on the ramp 81 slides or rolls along the latter to the discharging line 82. Actuation of the conveyor belt 84 along the Y axis enables the motion of the printed object 1 away from the machine 10.

In order to increase the pace of the machine 10, the pretreatment, on the one hand, and the printing followed by the drying, on the other hand, are performed in parallel. This refers to operations carried out in concurrent operation time mode.

More specifically, while a first untreated object placed on the first support 11 is gripped by the first object holder 50, simultaneously a second pretreated object placed on the second support 12 is gripped by the second object holder 70. This situation is represented in FIG. 2.

Then, the object holders are moved simultaneously in a manner so as to bring the first and second objects respectively in the pretreatment position and in the first printing position. This situation is represented in FIG. 3.

Actuation of the means 91 for the movement along the Z axis, common to the object holders 50 and 70, ensures the first movement of the beam 92 on which are mounted the two object holders. This first movement occurs over a distance of +ΔZ.

Simultaneously, the means for the movement along the X axis of the object holders are actuated independently one from the other so as to move the first object holder 50 by a distance of +ΔX1 and the second object holder by a distance +ΔX3.

Then, while the first object is in the pretreatment position, the second object passes successively into each of the printing positions, and then into the drying position. Only the means for the movement along the X axis of the second object holder 70 is then actuated so as to move the second object holder 70 on a distance of +(ΔX4+ΔX5). This situation is shown in FIG. 4.

Then, while the first object is still in the pretreatment position, the second object is released from the second object holder 70 in a manner so as to be transferred to the unloading means 80.

Then the object holders 50 and 70 are moved simultaneously so as to bring the pretreated object, held by the first object holder 50, into the second standby position, and simultaneously start the movement for returning the second object holder into its operative cycle start position. This situation is shown in FIG. 5.

Actuation of the means 91 for the movement along the Z axis common to the two object holders 50 and 70 ensures the second movement of the beam 92. This second movement occurs over a distance of −ΔZ.

Simultaneously, the means for the movement along the X axis of the first object holder 50 is actuated, and the first object holder 50 is moved by +ΔX2.

Then, the first object holder 50 is actuated so as to release the pretreated object that it holds, to place it on the second support 12.

Finally, the object holders 50 and 70 are moved simultaneously so as to bring the first object 50 into its operative cycle start position and the second object holder 70 into its operative cycle start position.

The means 95 and 98 for the movement along the X axis of the object holders are actuated independently of each other. The first object holder 50 is moved by a distance of −(ΔX1+ΔX2). The second object holder 50 is moved by a distance of −(ΔX3+ΔX4+ΔX5).

The person skilled in the art will understand that, by dedicating an object holder to the ink jet printing station, the precision required for high quality printing can be achieved.

The addition of a pretreatment processing step upstream of the printing station makes it possible to increase the pace.

The choice, through construction or by adjustment, of the positioning of each device provided on the machine makes it possible to reduce the number of movement means and/or provide to share some of the movement means required for the movements of the two object holders.

Numerous alternative embodiments of the machine are possible, in particular with respect to the positioning and the relative movements of the various devices or equipment units in relation to each other.

In the embodiment shown in FIGS. 1 to 5, the pretreatment device 41 is a device for pretreatment using plasma torch.

Figure 7:
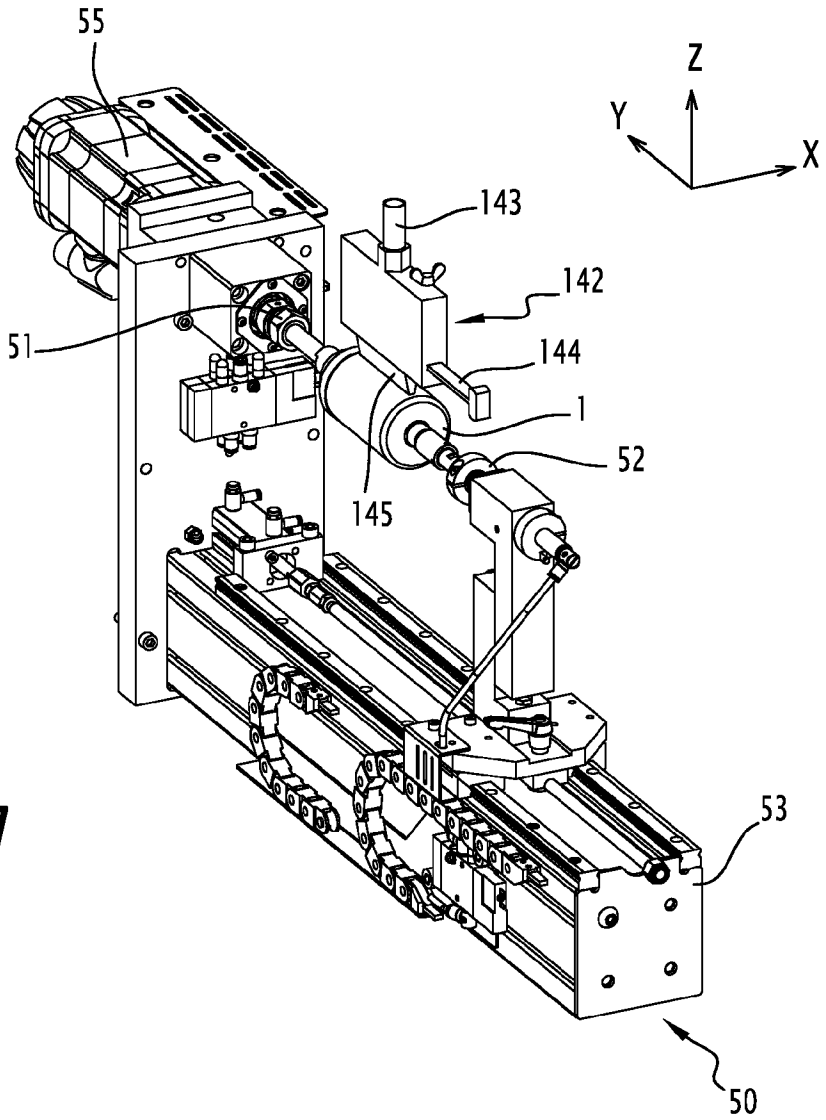
FIGS. 7 to 9 represent alternative embodiments of pretreatment the device of the printing machine.
Figure 9:
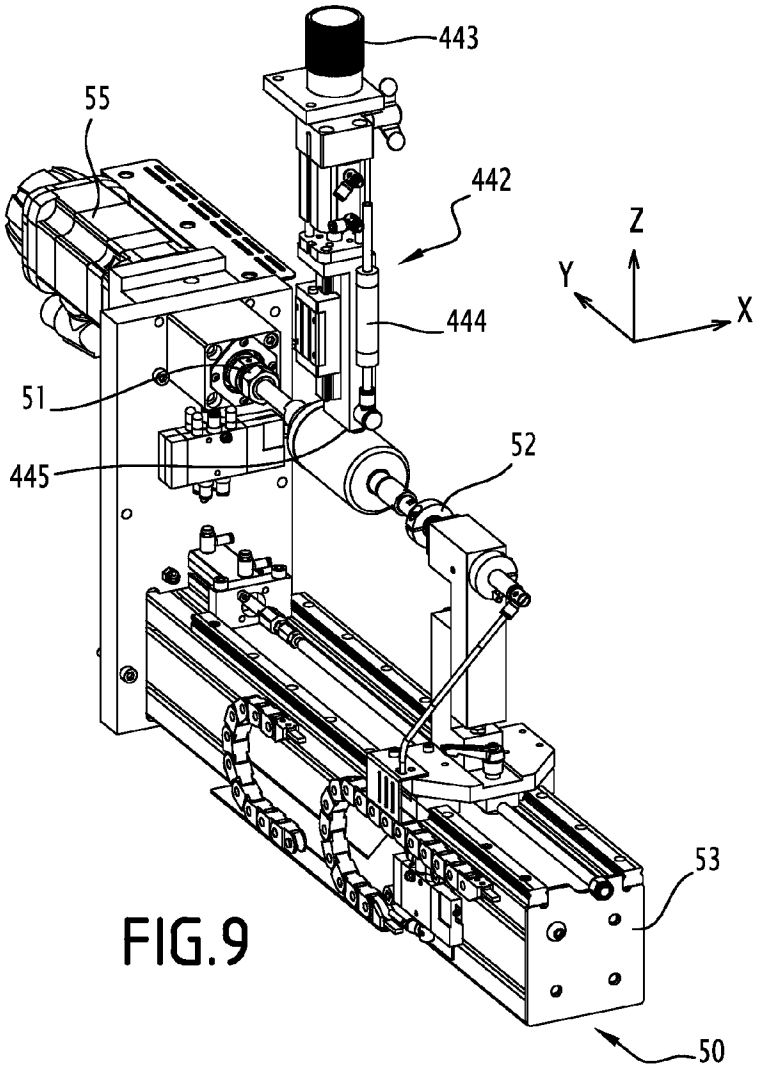
Figure 8:
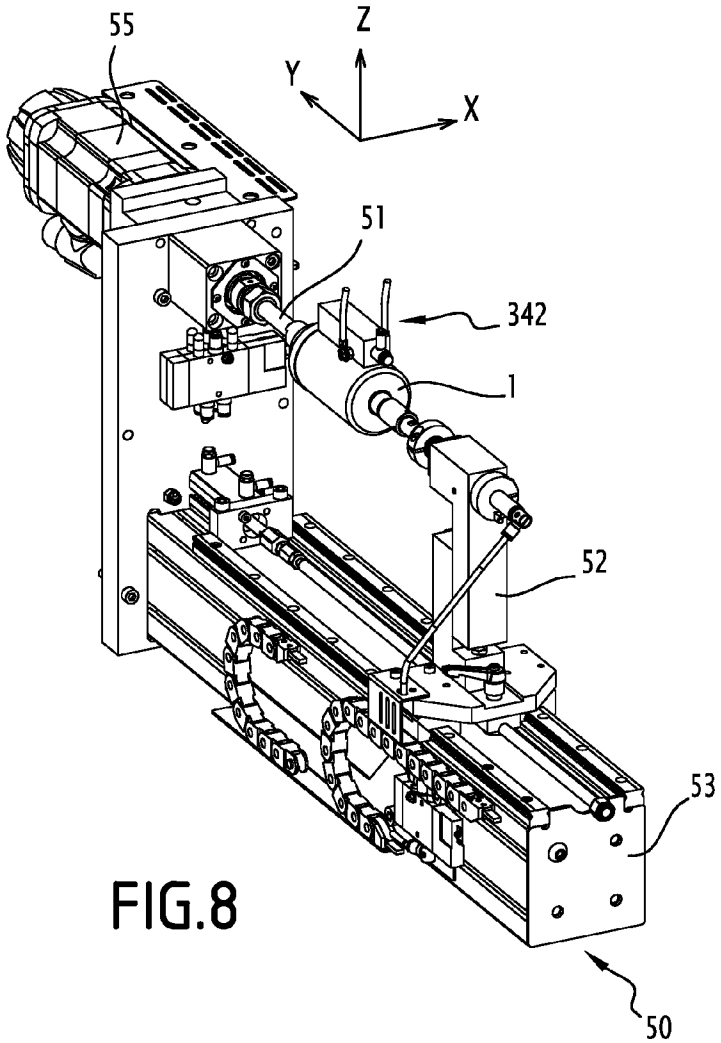

FIGS. 7 to 9 show alternative embodiments of the pretreatment device. In these figures, only the operational part of the pretreatment device is represented, whereas the object 1 to be pretreated is held in the pretreatment position by the first object holder 50.

In FIG. 7, the pretreatment device is a device for flame pretreatment . The burner 142 enables combustion of a fuel, supplied from a source through the channel 143, with the oxygen in the ambient air, detected and captured by the means 144 for generating a row along the axis Y, of flames 145.

In FIG. 8, the pretreatment device is a device for Corona pretreatment. It comprises a head 342 provided with a plurality of electrodes for the application of appropriate electrical discharges on the surface of the object to be treated.

Finally, in FIG. 9, the pretreatment device is a device for chemical pretreatment. The applicator 442 includes a felt pad 445 capable of being soaked with a liquid chemical product and applied against the portion of the surface of the object 1 to be pretreated. The applicator 442 includes a dropper 444 to be used to soak the pad with an appropriate flow of drops. The applicator 442 includes a button 443 for adjusting the pressure of application of the felt pad 445 on the object.

By way of various different pretreatment processes that it is possible to implement upstream of the printing station, the ink jet printing machine is universal.

In the embodiment described in detail here above, the object to be printed is cylindrical. Once it is placed in the printing position associated with a printing unit, the object is rotated about itself, in a manner so as to cause a portion of the object to be printed to run in front of the active printing unit. To do this, the second object holder is provided with a pivoting means 75. Furthermore, the printing unit may be displaced parallel to the pivoting axis so as to extend the portion of the surface of the object that is printed.

As an alternative, the object to be printed is flat. It is placed in a printing position associated with a printing unit, in a manner such that its planar surface is parallel to an XY plane. The object is then moved in translation relative to the printing unit along the X direction, in a manner so as to cause a portion of the object to run in front of the printing unit. To do this the second object holder is provided with a means for translation movement along the X axis. Advantageously, the printing units of the printing device being aligned along the X axis, the means for enabling the translation of the object in front of the printing unit is constituted by the means 98 for the movement along the X axis of the second object holder. More advantageously, the movement of the object in front of each printing unit as well as the movement of the object from one unit to another take place in a continuous manner, with the second object holder being driven at a constant speed along the X axis.

Furthermore, still according to this alternative relative to a flat object, whereas the object is placed in a printing position associated with a printing unit, the latter may be translated relative to the frame along the Y axis, in a manner so as to cause an extended portion of the object to run in front of this printing unit. To do this, the printing device is provided with a means for enabling translation along the Y axis, identical to the movement means 66 described in detail here above.

What is claimed is:

1. An ink jet printing machine including a loading means, a pretreatment station, a printing station and a unloading means, the pretreatment station including a pretreatment device and the printing station including an ink jet printing device, wherein the ink jet printing machine has a high degree of precision in the relative positioning between a surface of an object to be printed and ink ejection nozzles of the printing device, and wherein:

the loading means, the pretreatment station, the printing station and the unloading means are mounted on the same frame;

the loading means places an object on a first support provided on the frame, said first support defining a first standby position;

the pretreatment station includes a first object holder that grips the object on the first support in the first standby position; brings the obj ect into a pretreatment position in front of the pretreatment device; moves the object during a pretreatment process of the object performed by the pretreatment device; and, upon conclusion of the pretreatment process, places the object on a second support provided on the frame, said second support defining a second standby position;

the printing station includes a second object holder that grips the object on the second support in the second standby position; brings the said object into a printing position in front of the printing device and maintains the object in this printing position while a printing process is performed on the object by the printing device; moves the object during the printing process performed on the object by the said printing device by rotating the object about an axis, in a manner such that different generatrices of the object pass in front of the printing device; and, upon conclusion of the printing process, transfers the object to the unloading means, the printing device being mounted to be movable in translation relative to the frame, parallel to the axis.

2. The printing machine according to claim 1, wherein the pretreatment station and the printing stations operate in a concurrent operation time mode.

3. The printing machine according to claim 1, wherein the first and second supports having identical Z axis coordinates and the pretreatment position and the printing position having identical Z axis coordinates, the first and second object holders are moved along the Z axis by a common Z axis movement means comprising a beam, extending parallel to an X axis of the frame and mounted to be movable in translation along the Z axis relative to the frame, and a single actuator capable of moving the beam along the Z axis.

4. The printing machine according to claim 3, wherein the first and second object holders are mounted to be movable in translation on the said beam, each object holder being associated with a movement means capable of moving the corresponding object holder in translation along the longitudinal axis of the beam.

5. The printing machine according to claim 1, wherein the pretreatment device is selected from among: a device for plasma pretreatment, a device for flame pretreatment, a device for corona pretreatment and a device for chemical pretreatment.

6. The printing machine according claim 1, wherein the printing station includes, downstream from the printing device, a drying device.

7. The printing machine according claim 1, wherein the second object holder is provided with an auxiliary drying device.

8. The printing machine according to claim 1, wherein the first and second supports have a shape that is adapted to that of the object, in a manner so as not to be in contact with the portion of the surface of the object to be printed.

9. The printing machine according to claim 1, wherein the printing device comprises at least one printing unit, and the second object holder includes a pivoting means capable of moving the object relative to an active printing unit of the printing device, by rotation about a holding axis along with the object is held by the object holder.

10. The printing machine according to claim 1, wherein the printing device is mounted to be movable in translation relative to the frame in a manner such that an active printing unit of the printing device propels ink droplets on a segment of the surface of the object held by the second object holder while the printing device is translated relative to the frame, the object being held such that said segment extends parallel to the direction of translation of the printing device.

11. The printing machine according to claim 1, wherein the printing device comprises a plurality of printing units arranged successively along an X axis of the frame, a printing position being associated with each printing unit of the printing device, the machine including a movement means for moving the second object holder along the X axis in order to move the object sequentially from one printing position to a subsequent printing position.

12. The printing machine according to claim 7, wherein the auxiliary drying device is operable for drying a portion of the printed surface of the object.

* * * * *